US006159307A

United States Patent [19]

Zylla

[11] Patent Number: 6,159,307

[45] Date of Patent: Dec. 12, 2000

[54] METHOD OF ANNEALING NONFERROUS METAL PARTS WITHOUT STICKERS

[75] Inventor: Peter Zylla, Krefeld, Germany

[73] Assignee: Messer Griesheim GmbH, Frankfurt, Germany

[21] Appl. No.: 09/319,858

[22] PCT Filed: Nov. 17, 1997

[86] PCT No.: PCT/EP97/06394

§ 371 Date: Jun. 11, 1999

§ 102(e) Date: Jun. 11, 1999

[87] PCT Pub. No.: WO98/27243

PCT Pub. Date: Jun. 25, 1998

[30] Foreign Application Priority Data

Dec. 18, 1996 [DE] Germany ..... 196 52 607

[51] Int. Cl.[7] ..... C23C 28/00

[52] U.S. Cl. ..... 148/276; 148/276; 148/284; 148/712; 148/687

[58] Field of Search ..... 148/276, 277, 148/284, 708, 712, 687; 75/641

[56] References Cited

U.S. PATENT DOCUMENTS

| | | | |
|---|---|---|---|
| 896,811 | 8/1908 | Edison | 148/712 |
| 1,815,505 | 7/1931 | Guthrie et al. | 148/712 |
| 2,320,962 | 6/1943 | Wilson | 148/276 |
| 2,379,736 | 7/1945 | Miller | 148/284 |
| 2,810,667 | 10/1957 | Hohn et al. | 148/712 |
| 4,443,274 | 4/1984 | Brock et al. | 148/284 |
| 4,515,645 | 5/1985 | Bohm | 148/712 |
| 5,344,509 | 9/1994 | Zylla . | |

FOREIGN PATENT DOCUMENTS 42 07 394 2/1993 Germany .

OTHER PUBLICATIONS

Metals Handbook, Ninth Edition, vol. 4, Heat Treating, American Society for Metals, 1981, pp. 395–396.

Patent Abstracts of Japan, Publication No. 55104462, Mitsubishi Metal Corp., Sep. 9, 1980.

Patent Abstracts of Japan, vol. 004, No. 159 (C–030), Nov. 6, 1980 & JP 55 104462A (Mitsubishi Metal Corp.) Aug. 9, 1980.

Database WPI, Section Ch, Week 8551, Derwent Publications Ltd., London, GB; Class M13, AN 85–321876 XP002058985 & JP 55 010 903 A (Mitsubishi Metal Corp.).

Patent Abstracts of Japan, vol. 010, No. 144 (C–349), May 27, 1986 & JP 61 003876A (Nippon Kogyo KK), Jan. 9, 1986.

Patent Abstracts of Japan, vol. 007, No. 034 (C–150), Feb. 10, 1983 & JP 57 185963 A (Hitachi Densen KK), Nov. 16, 1982.

Chemical Abstracts, vol. 115, no. 11, 1991, Clumbus, Ohio, abstract no. 113605a, Zaiga, Laszlo; Nagy, Jozsef: "Manufacture of ammonium hydroxide from liquid ammonia"XP0000250756 & HU 54 943 A29, April 1991 (Apr. 04, 1991).

*Primary Examiner*—John Sheehan
*Assistant Examiner*—Andrew L. Oltmans
*Attorney, Agent, or Firm*—Connolly Bove Lodge & Hutz LLP

[57] ABSTRACT

Process to avoid adhesions during the annealing of nonferrous metal alloys, comprising the heating, holding and cooling phases, whereby the material being annealed is exposed to an inert or oxidizing protective-gas atmosphere during the structure transformation, as a result of which a thin oxide layer is formed during this time on the surface of the material being annealed and/or an oxide layer that was previously there is maintained, thus preventing the nonferrous metal objects from adhering together.

5 Claims, 2 Drawing Sheets

State Diagram Of Copper-Tin In Actual Practice (Broke Line) Taking Into Consideration The Diffusion Inertia Of Tin

METHOD OF ANNEALING NONFERROUS METAL PARTS WITHOUT STICKERS

BACKGROUND OF INVENTION

The invention relates to a process to anneal non-ferrous metal objects in an adhesion-free manner, that is to say, to avoid so-called adhesions during the annealing procedure, especially in a bell-type furnace.

Non-ferrous metals such as, for instance, bronze wires or bronze strips undergo a homogenizing annealing step after the casting and shaping. Subsequently, additional shaping measures such as rolling or drawing are taken and re-crystallization annealing steps are carried out.

The annealing temperatures lie between 300° C. and 700° C. [572° F. and 1292° F.]. The annealing is conducted in continuous furnaces, a relatively complex approach in view of the fact that the objects usually have a small cross section.

When annealing coils, which can be done, for example, in bell-type furnaces, local diffusion welds, so-called adhesions, occur at the contact sites of the objects, for example, between individual windings of the wound-up wire or strip, due to diffusion mechanisms. Upon further processing, that is, during winding, these adhesions cause cracks on the surface of the material, thereby giving rise to surface defects. As a consequence, of course, adhesions are highly undesirable on annealed non-ferrous metal objects.

In this context, the term non-ferrous metals refers to alloys whose main components are copper, tin, aluminum and lead, whereby many other components are also possible such as, for instance, magnesium, nickel, etc.

In order to avoid adhesions when annealing steel strips, DE 4207394 discloses the approach of changing the water-gas equilibrium in a targeted manner in the presence of $H_2$, $CO_2$, CO and $H_2O$ in the protective-gas atmosphere in such a way that a totally oxidizing atmosphere is available at the end of the holding phase, while a totally reducing atmosphere is available in the cooling phase. This approach, however, cannot be used for non-ferrous metals due to the much lower temperatures that are found at times, for instance, 400° C. [752° F.], and due to the detrimental effect on the part of the reaction products, such as CO and $H_2O$, on the oxidation mechanism.

SUMMARY OF INVENTION

The invention is based on the objective of creating a process with which it is possible to avoid adhesions during the annealing of non-ferrous metal objects, especially non-ferrous metal coils, in bell-type furnaces.

In accordance with the invention the material being annealed is exposed to an inert or oxidizing protective-gas atmosphere. As a result, a thin layer is formed during this time on the surface of the material being annealed and/or an oxide layer that was previously present was maintained thus preventing the non-ferrous metal objects from adhering together.

BRIEF DESCRIPTION OF THE DRAWINGS

The invention will be explained in greater detail below with reference to the example of an embodiment in conjunction with a drawing, whereby.

DETAILED DESCRIPTION

First of all, the example of a copper-tin alloy (bronze) is employed to illustrate the problem of the adhesion of individual windings during the annealing of non-ferrous metal coils.

Due to their large solidification interval, copper-tin alloys tend to form zone crystals when they are cast. These solidification intervals are one of the reasons for the reverse block segregation associated with pronounced differences in concentration throughout the cross section. This can be accompanied by exudation on the surface. These concentration differences are the reason why a heterogeneous structure can already form at low tin contents in the cast state. The extent of segregation depends on the cooling conditions. The faster the cooling takes place, the lower the tin contents are at which the theoretical boundary of the homogeneous area lies.

Figure 1:
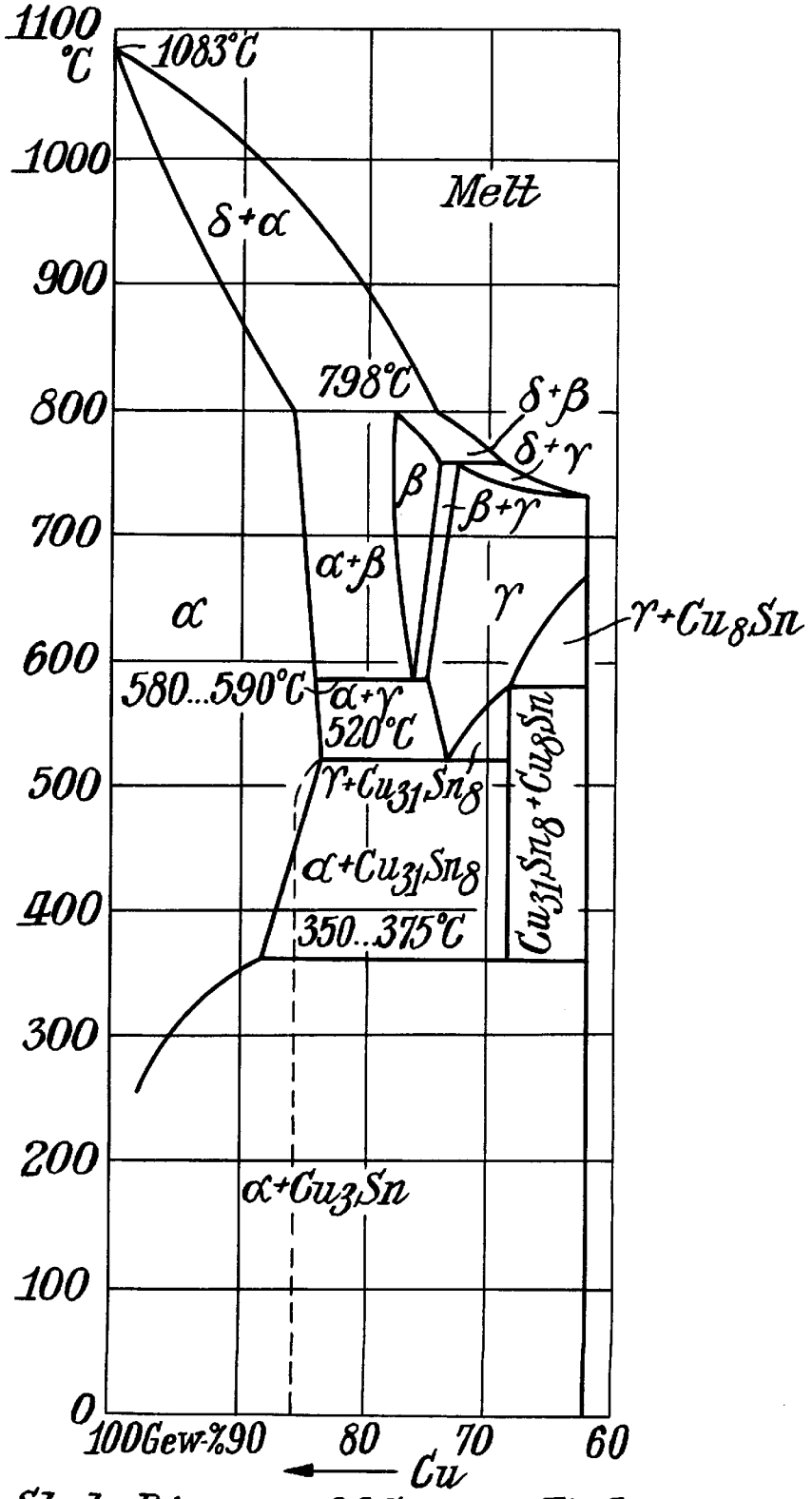
FIG. 1 shows a state diagram of copper-tin.

FIG. 1 depicts a state diagram of the copper-tin alloys. As can be seen in the illustration, the $\gamma$-crystal breaks down eutectically at 520° C. [968° F.] into $\alpha+\delta$, and the $\delta$-phase, in turn, eutectically converts into $\alpha+\epsilon$ at a temperature of approximately 350° C. [662° F.], a process in which the compound $Cu_{31}Sn_8$ is the $\delta$-phase and $Cu_3Sn$ is the $\epsilon$-phase. This conversion takes place extraordinarily slowly, so that technical alloys display an $(\alpha+\delta)$-eutectoid in their final state, even when they have been cooled off slowly.

The tin-concentration differences within a crystal can amount to up to 10%. Homogenization annealing has the objective of compensating for these differences to the greatest extent possible. Dissolution of the $\delta$-component during annealing is achieved within the range from 650° C. to 700° C. [1202° F. to 1292° F.], as a result of which there is a considerable increase in the dilatation. The yield strength also rises when the dilatation increases.

Copper-tin alloys are normally cast in an air atmosphere and are usually cold-shaped. This means that the surface is strongly oxidized. For this reason, strongly reducing protective-gas atmospheres are currently employed during the homogenization annealing that has to be carried out subsequently. The hydrogen fraction of commonly employed protective gases amounts to approximately 100 vol-%. In this manner, the oxides are already reduced in the heating phase. As a result of the reduction of the oxides, which is accompanied by exudation on the surface, the surfaces of wires or strips are bright after the annealing treatment, although they adhere strongly. Further processing presupposes a mechanical re-working of the surface, as a result of which it is very time-consuming and costly.

Over the course of several laboratory experiments under operating parameters, cold-shaped cast samples of bronze wire underwent homogenizing annealing, first under reducing protective-gas atmospheres (75% $N_2$, 25% $H_2$). In the case of bronze wire, strong exudation was observed on the surface of the treated samples. This exudation frequently tended to occur at those sites where the concentration of tin due to segregation was the highest. The strongly reducing protective-gas atmosphere obviously could not promote this process. Under reducing, hydrogenous atmospheres, reduction of the oxides on the surface already takes place in parallel during the heating phase and this reduction is most intense on the grain boundaries, which is comparable to a thermal etching.

The grain boundaries, which are open towards the outside, probably are the sites at which a low-melting tin phase exuded as a result of a conversion of a structure that is not yet homogeneous. Since the windings lie very closely together when coils are annealed, this gives rise to bridges, referred to as adhesions, which form a fused bond between two adjacent surfaces.

In additional experiments, the hydrogen fraction in the protective-gas atmosphere was constantly lowered. It was observed that, as the reduction capacity of the protective-gas atmosphere dropped, the exudation became increasingly less. Finally, experiments were conducted with inert or oxidizing protective-gas atmospheres, whereby carbon dioxide was employed as the oxidant.

Figure 2:
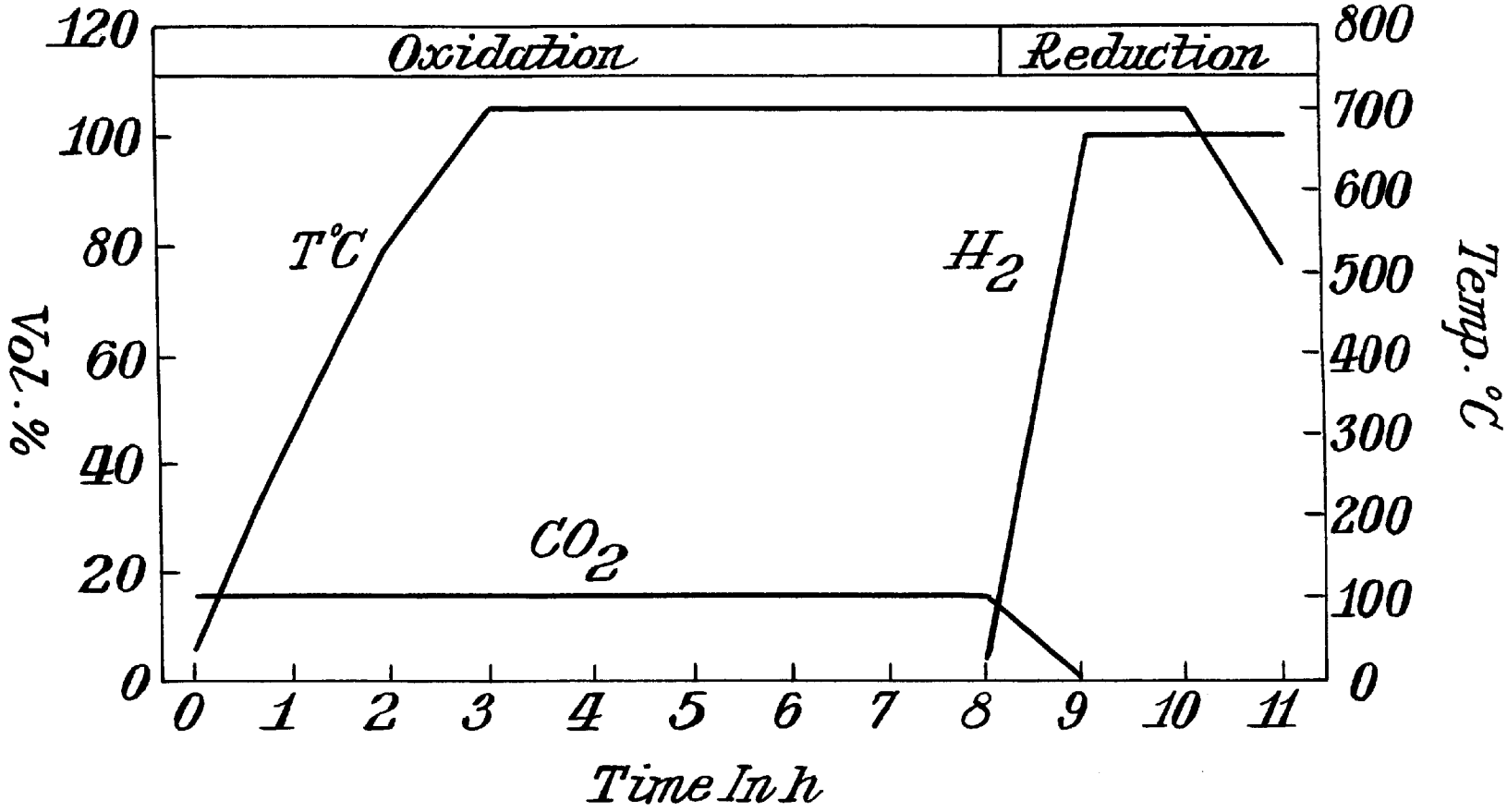
FIG. 2 shows the course of the temperature over time and the composition of a protective-gas atmosphere used for the adhesion-free treatment of bronze wire.

An example of such a treatment is explained in FIG. 2. A gas mixture with 15% vol-% $CO_2$ (rest $N_2$) ensured that the oxide layers were maintained in the heating and holding phases and, depending on the alloy elements—for instance, during intermediate annealing of shaped wires which had already been cold-shaped—brought about an additional oxidation by the $CO_2$ fraction, even at temperatures of 400° C. [752° F.]. In this manner, it was possible to stop exudation from the annealed material by means of a protective sheathing of the surface with a thin oxide layer, and the batches were annealed without adhesions. At the same time, better conditions were created for the homogenization process.

Finally, in order to once again reduce the oxide layer maintained or re-constituted in the heating phase or at the beginning of the holding phase, the $N_2$—$CO_2$ protective-gas atmosphere was replaced by a pure hydrogen atmosphere at the end of the holding phase. This created strongly reducing conditions for the end of the holding phase as well as for the cooling period, and the oxide layers which protect against adhesions were then eliminated. The batches were bright-annealed without the occurrence of adhesions. The change over time of the decisive parameters is presented once again in the overview below:

Test parameters for bronze wire treatment

| Time [hours] | Temperature | $CO_2$ [%] | $H_2$ [%] |
|---|---|---|---|
| 0 | 25° C. [77° F.] | 15 | 0 |
| 1 | 290° C. [554° F.] | 15 | 0 |
| 2 | 530° C. [986° F.] | 15 | 0 |
| 3 | 700° C. [1292° F.] | 15 | 0 |
| 4 | 700° C. [1292° F.] | 15 | 0 |
| 5 | 700° C. [1292° F.] | 15 | 0 |
| 6 | 700° C. [1292° F.] | 15 | 0 |
| 7 | 700° C. [1292° F.] | 15 | 0 |
| 8 | 700° C. [1292° F.] | 15 | 0 |
| 9 | 700° C. [1292° F.] | 0 | 100 |
| 10 | 700° C. [1292° F.] | 0 | 100 |
| 11 | 500° C. [932° F.] | 0 | 100 |

Additional experiments have shown that the same results are obtained with other non-ferrous metal alloys such as, for instance, nickel brass (Cu—Ni—Zn).

The heat treatment of wire cast in air, which already has a pronounced oxide layer, would also be possible in the holding phase, even with an inert protective-gas atmosphere, for example, with pure nitrogen. The oxide layer could be subsequently reduced with hydrogen in the cooling phase in order to achieve a bright annealing result.

Individually as well as in any desired combination, the invention features disclosed in the preceding description, in the drawing as well as in the claims can be essential for the realization of the invention in its various embodiments.

I claim:

1. Process to avoid adhesions during annealing of metal objects consisting of a non-ferrous metal alloy, comprising a heating, a holding and a cooling phase, whereby the surface of the metal objects has an oxide layer, characterized in that during the holding phase the metal objects are exposed to an inert protective-gas atmosphere, as a result of which the oxide layer is maintained on the surface of the metal objects being annealed thus preventing the non-ferrous metal objects from adhering together, whereby at one of the end of the holding phase and the beginning of the cooling phase, the inert protective-gas atmosphere is replaced by a reducing atmosphere of pure hydrogen, thus reducing the oxide layer and ensuring a bright surface of the annealed metal objects.

2. Process according to claim 1, characterized in that the inert protective-gas atmosphere consists of $N_2$.

3. Process to avoid adhesions during annealing of metal objects consisting of a non-ferrous metal alloy, comprising a heating, a holding and a cooling phase, characterized in that during the heating and during the holding phase the metal objects are exposed to an oxidizing protective-gas atmosphere, as a result of which a thin oxide layer is formed on the surface of the metal objects being annealed thus preventing the non-ferrous metal objects from adhering together, whereby at one of the end of the holding phase and the beginning of the cooling phase, the oxidizing protective-gas atmosphere is replaced by a reducing atmosphere of pure hydrogen, thus reducing the oxide layer and ensuring a bright surface of the annealed metal objects.

4. Process according to claim 3, characterized in that the oxidizing protective-gas atmosphere contains carbon dioxide.

5. Process according to claim 4, characterized in that the oxidizing protective-gas atmosphere contains at least 10 vol-% of carbon dioxide.

* * * * *